United States Patent [19]

Hösel

[11] Patent Number: 4,587,691

[45] Date of Patent: May 13, 1986

[54] METHOD AND APPARATUS FOR FEEDING FIBER MATERIAL TO A PLURALITY OF FIBER PROCESSING MACHINES

[75] Inventor: Fritz Hösel, Monchen-Gladbach, Fed. Rep. of Germany

[73] Assignee: Trützschler GmbH & Co. KG, Monchen-Gladbach, Fed. Rep. of Germany

[21] Appl. No.: 696,056

[22] Filed: Jan. 29, 1985

[51] Int. Cl.[4] ..... D01G 7/06

[52] U.S. Cl. ..... 19/80 R; 19/81; 19/145.5

[58] Field of Search ..... 19/80 R, 81, 145.5

[56] References Cited

U.S. PATENT DOCUMENTS

| | | | |
|---|---|---|---|
| 4,297,766 | 11/1981 | Trützschler | 19/80 R |
| 4,363,585 | 12/1982 | Keller et al. | 19/80 R |
| 4,493,131 | 1/1985 | Dragagna et al. | 19/80 R |
| 4,507,826 | 4/1985 | Keller et al. | 19/80 R |
| 4,514,881 | 5/1985 | Hergeth et al. | 19/80 R |

*Primary Examiner*—Louis K. Rimrodt
*Attorney, Agent, or Firm*—Spencer & Frank

[57] ABSTRACT

A method of selectively supplying fiber material from an output of a fiber bale opener to a plurality of fiber processing lines each formed of a series of fiber processing machines, includes the steps of removing fiber by the bale opener sequentially from bales of different fiber types; supplying predetermined fiber processing lines with predetermined types of fiber by the bale opener; sensing a fiber quantity requirement of the fiber processing line while being supplied with fiber by the bale opener while the latter simultaneously performs fiber removal from the bales of a predetermined fiber type; interrupting the fiber removal at that location of the bale opener where it is situated when the fiber processing line then supplied with fiber, signals satisfaction of fiber requirement; and resuming fiber removal of the predetermined fiber type at the mentioned location upon a signal for fiber requirement by the fiber processing line supplied at the time of interruption.

8 Claims, 3 Drawing Figures

METHOD AND APPARATUS FOR FEEDING FIBER MATERIAL TO A PLURALITY OF FIBER PROCESSING MACHINES

BACKGROUND OF THE INVENTION

This invention relates to a method and an apparatus for supplying fiber material to a plurality of fiber processing machines, such as fiber storing devices, fiber cleaners, mixers and the like. A fiber bale opener removes fiber tufts from a plurality of fiber bales having at least two types of fibers. Predetermined partial quantities of the individual fiber types are successively taken from the fiber bales and are admitted to the associated fiber processing machines.

In a known process for operating a bale opener for fiber bales containing cotton fiber or chemical fiber or fiber waste and the like, a travelling fiber bale opener is used which has a carriage carrying a tower, which in turn, supports a horizontally projecting cantilever accommodating an opening device comprising, for example, a rapidly rotating toothed opening roller. The bale opener travels along the fiber bales and the opening device removes fiber tufts from the bale top. Frequently, different fiber types are processed and, for this purpose, two or more fiber bale groups, each comprising one or more fiber bales are positioned in a series. The bales within one group consist of one type of fiber material. Between the fiber bale groups there is provided an intermediate space which is void of fiber material. A separate fiber processing line, each formed of a plurality of serially arranged fiber processing machines is provided for each type of fiber material and is operatively connected with the bale opener. The fiber processing lines have, as a rule, different input requirements, or the fiber processing machines have a different storing capacity. Such fiber processing lines may involve the problem that they cannot take up excess fiber material from the bale opener beyond a certain limit. If, for example, in the processing of cotton A and chemical fibers B the two processing lines connected downstream of the bale opener require fiber material, first fiber material is removed from the fiber bale group A (in one pass of the bale opener) and thereafter fiber material from the group B is taken (during one pass) and thereafter again the group A is worked on. After a predetermined period, the material requirement of the fiber processing machines is satisfied. Dependent upon where the opening device is momentarily situated with respect to the bale series (that is, at the beginning, at the middle or at the end) there will be a continued delivery of some material amount since in the prior art arrangements the bale opener has to complete its pass once it has begun. On occasion, in an unfavorable case, when the opening device has just started a pass and no more fiber is needed, fiber material of the entire pass will still be delivered. The bale opener cannot discontinue fiber tuft removal from the bales in the course of the pass because otherwise steps would appear in the upper face of the fiber bales. Such step formations must be avoided for technological reasons. Thus, the fiber processing machines would need an excessively large material storing device which is capable of absorbing fiber material resulting from a complete pass. This circumstance, however, would, because of the need of undesired modifications, prevent the use of existing fiber processing machines in the above-described environment. Further, in case of a disproportionate bale arrangement, such as excessively large or excessively small quantities of one fiber type, may result in the disadvantage that the processing machines associated with the fiber type of small quantity is supplied only with an insufficient amount of fiber material.

SUMMARY OF THE INVENTION

It is an object of the invention to provide an improved method and apparatus of the above-outlined type from which the discussed disadvantages are eliminated and which, in particular, makes possible the feeding of fiber material corresponding to the material requirement of the after-connected fiber processing machines and further, no steps are formed in the bale surface.

These objects and others to become apparent as the specification progresses, are accomplished by the invention, according to which, briefly stated, the fiber tuft removal from a bale group having a particular fiber type is immediately discontinued at any location along the bale group as soon as the material requirement of the associated fiber processing machine is satisfied and further, in case of a renewed requirement for fiber material of the same type, the opening device resumes operation at the same location where the previous opening process for that fiber type has been discontinued.

It is thus an important feature of the invention that the opening process, that is, the removal of fiber tufts from the fiber bales is immediately discontinued as soon as the requirement of the associated fiber processing apparatus is satisfied. In this manner it is avoided that excess fiber material is produced which cannot be stored or, in case of a continuous operation, cannot be processed. The opening operation is discontinued at any location of the fiber bale series. It is further of importance that the fiber tuft removal is resumed—if that type of fiber is again required—at the same location after fiber material of another type has been removed from another bale series to supply, in the meantime, another fiber processing machine. In this manner, only required quantities are supplied without, however, forming step-like surfaces in the top of the fiber bales.

According to a further feature of the invention, the fiber removal process is discontinued only after a delay of, for example, three to five seconds. In this manner, an interruption of the material feed is effected with a time delay, that is, the information that fiber material is needed is processed only when the need persists for a predetermined period. In this manner, a short-period transitional actuation of the measuring device will not cause an interruption of the fiber removal process. Expediently, the fiber removing process is performed until the end of a bale group (one type of fiber material) in case the fiber opening device of the bale opener has exceeded a predetermined short distance from the end of the bale series. In this manner, no interruption in the fiber removal process will take place if the bale opener is situated at a presettable short distance from the end of the respective fiber bale group. This arrangement prevents a resumption of the fiber removing process in case of negligibly small remnants of the fiber bale top.

The apparatus for performing the method according to the invention has measuring devices which determine the fiber quantities in the fiber processing machines and which are connected to a control device which controls the opening process. For determining the horizontal position of the carriage or the tower and for determining the vertical position of the opening device, the apparatus has separate measuring devices which are connected with the control device. In this manner, all motions in the working direction of the opening device (X-axis and Y-axis) are sensed by a measuring device. Further, the control device has a computer which is connected with the measuring devices and a memory and receives, by means of an interface, information concerning fiber material requirements by the fiber processing machines. If, during a pass no more material is required (for example, from the bale group A), the bale opener stops and the computer requests data of the X and Y position from the measuring devices and causes the received information to be stored. Thereafter, the opening device of the bale opener is raised off the bale surface and the bale opener travels to another bale group, for example, to bale group B from which fiber material is required by another fiber processing machine. If, at a later period, again material is needed to be removed from the bale group A, the bale opener travels to the position at which the earlier removal from group A has been interrupted, the opening device is lowered onto the bale of group A according to the stored height information and the fiber removing process is resumed.

According to a further feature of the invention, the carriage or the tower of the bale opener is provided with a sensor which responds to a stationary marking element. Expediently, the drive for the height adjustment of the opening device is associated with a counter. Preferably, the control device is connected with a buffered memory to prevent loss of information from the memory in case of discontinuing the operating voltage of the bale opener.

DESCRIPTION OF THE PREFERRED EMBODIMENT

Figure 1:
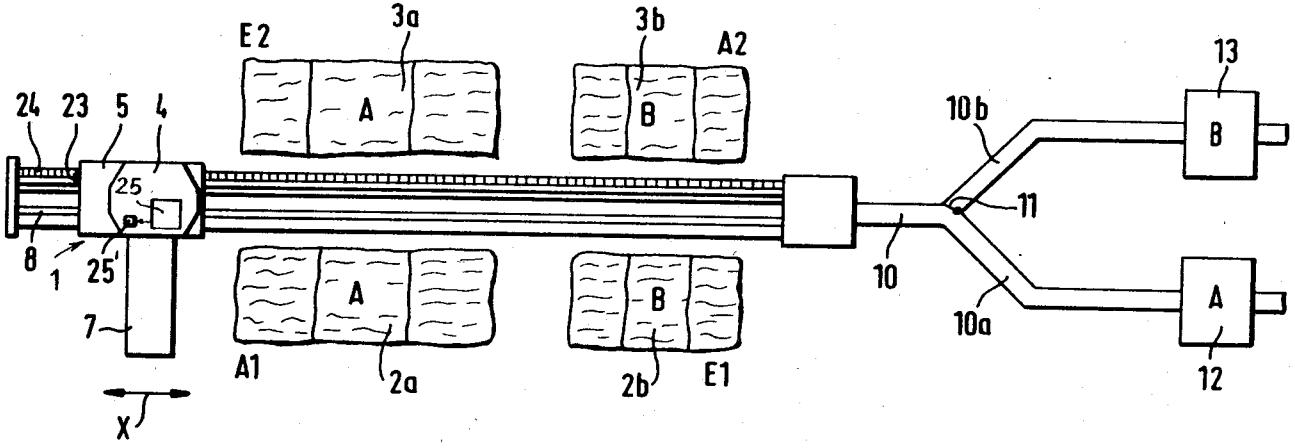
FIG. 1 is a schematic top plan view of a bale opener and an after-connected fiber processing system incorporating a preferred embodiment of the invention.
Figure 2:
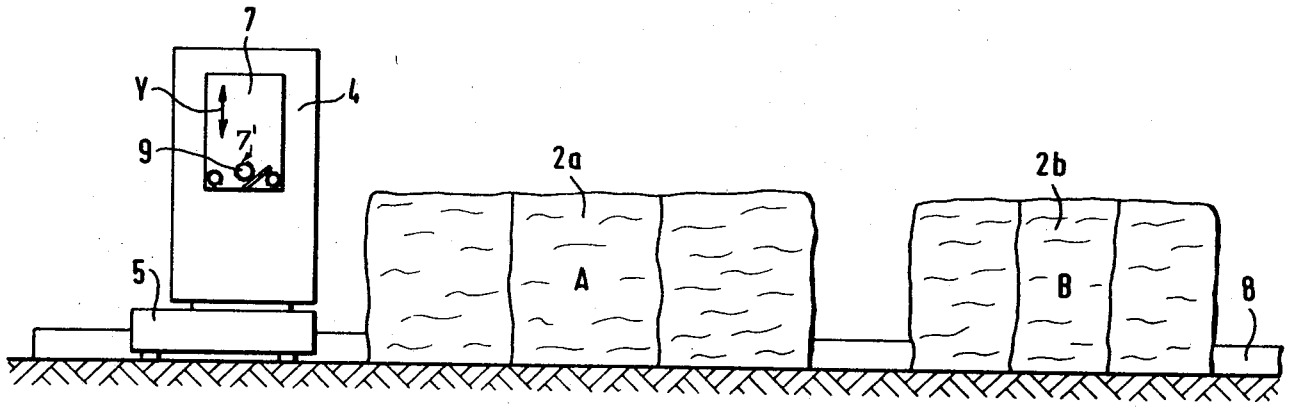
FIG. 2 is a schematic side elevational view of the bale opener illustrated in FIG. 1.

Turning to FIG. 1, the fiber processing system shown therein comprises a fiber bale opener which is generally designated at 1 and which may be a "BLENDOMAT" model, manufactured by Trützschler GmbH & Co. KG, Mönchengladbach, Federal Republic of Germany. The bale opener 1 removes fiber tufts from the top of fiber bale groups 2*a*, 2*b*, 3*a*, 3*b*. It is assumed that groups 2*a*, 3*a* consist of bales of the fiber type A, while groups 2*b*, 3*b* consist of bales of the fiber type B. The bale opener 1 has a tower 4 which is mounted on a carriage 5 for rotation about a vertical axis and the carriage is provided with wheels for a back-and-forth travel. The tower 4 supports a cantilever 7 which, as shown in FIG. 2, houses the opening device proper, designated generally at 7'. The cantilever 7, together with the opening device 7' is movable relative to the tower 4 in a vertical direction as indicated by a double-headed arrow Y. The opening device 7' comprises a rapidly rotating toothed opening roller 9 which removes fiber tufts from the upper face of the fiber bales. Underneath the tower 4 there extends a duct 8 for receiving and pneumatically transporting the removed fiber tufts. The duct 8 is adjoined by a conduit 10 which branches into two conduits 10*a* and 10*b*. At the branch-off location a routing gate 11 is located. The conduit 10*a* leads to a fiber storing device 12 for the fiber type A while the conduit 10*b* leads to a fiber storing device 13 for the fiber type B. With each fiber storing device 12 and 13 there are associated fiber processing machines (not shown) such as mixers, openers, cleaners, tuft feeding chutes and carding machines.

In operation, the carriage 5, together with the tower 4 travels back-and-forth along free-standing fiber bale groups as indicated by the double-headed arrow X. The gate 11 is set to direct fiber from the conduit 10 to the conduit 10*a*. First, the bale opening device 7' travels from the beginning A1 to the end E1 of the bale series 2*a*. The removed fiber tufts of the type A are conveyed through the duct 8 and the conduits 10 and 10*a* to the storing device 12. As soon as no more fiber A is needed by the storing device 12, the opening process performed on the fiber material A of the bale series 2*a* is immediately suspended at the location where the cantilever 7 is momentarily situated. Thereafter, the bale opener travels to the bale series 2*b*, so that the cantilever 7 is positioned on the bale top of the group 2*b* and the fiber removing operation continues there. The gate 11 is switched to direct fiber from the conduit 10 to the conduit 10*b*. The removed fiber tufts of the fiber type B are advanced through the duct 8 and the conduits 10 and 10*b* to the material storing device 13. As soon as the material storing device 13 needs no more fiber material of the type B, the removal of fiber tufts of the fiber type B from the bale series 2*b* is immediately interrupted at the location where the cantilever 7 is momentarily situated. Thereafter, the opening device 7' is moved again to the bale series 2*a* where it will continue the opening process at the location where the previous opening process that removed fiber A was interrupted. Upon fully consuming the bale series 2*a* and 2*b*, the tower 4 and the cantilever 7, together with the opening device 7' are rotated through an angle of 180° about a vertical axis. In this manner, the opening device 7' will be positioned at the beginning A2 of the bale series 3*b*. From that position, the opening process of the bale series 3*b* and 3*a* in the direction E2 begins in a manner described in connection with the bale series 2*a* and 2*b*.

Figure 3:
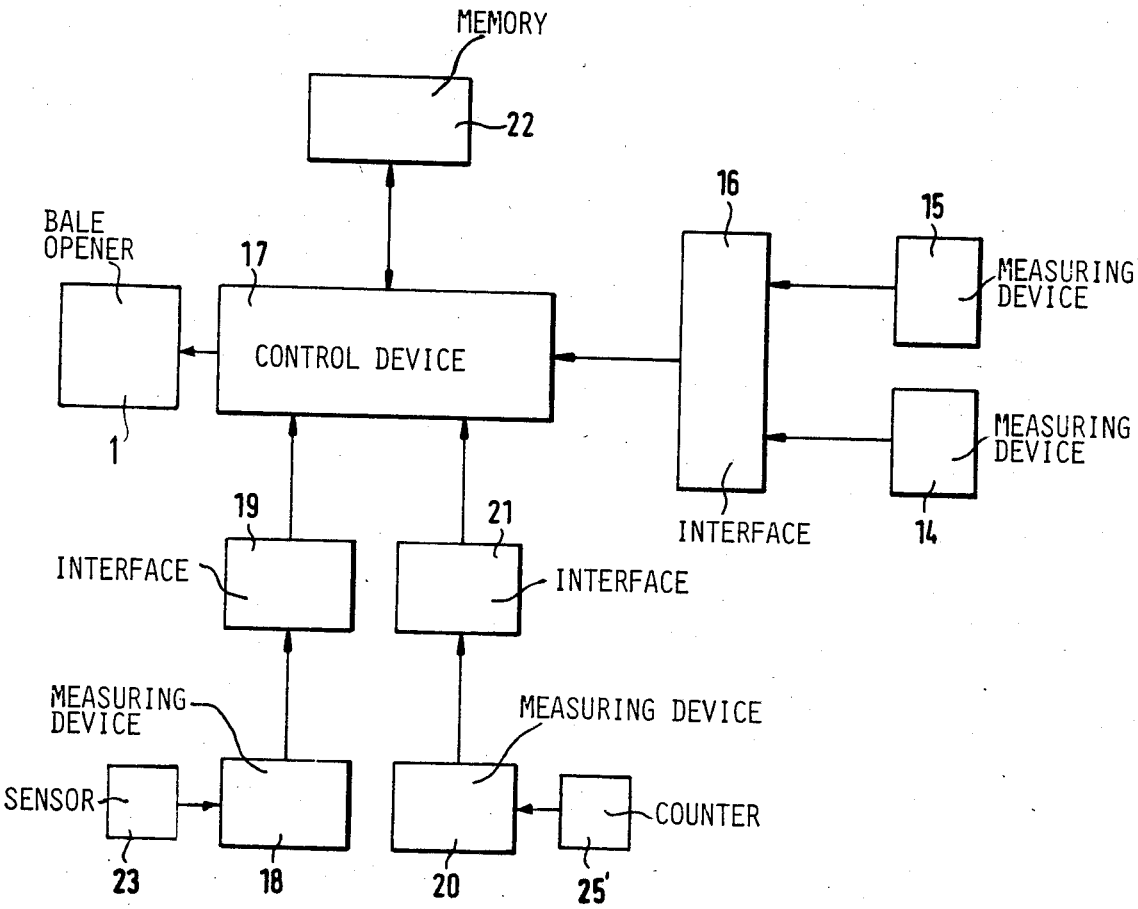
FIG. 3 is a block diagram of an electric circuitry for practicing the invention.

Turning now to FIG. 3, the measuring devices 14 and 15 which determine the fiber material needs for the fiber types A and B, and which may be photocells installed in the material storing devices 12 and 13 are connected by means of an interface 16 with a control device 17 such as a microcomputer equipped with a microprocessor. The control device 17 may be a TMS Model with a Rockwell 6502 microprocessor, manufactured by Trützschler GmbH & Co. KG, Mönchengladbach, Federal Republic of Germany. Further, the measuring device 18 for determining the position (X-axis) of the carriage 5 is connected by means of an interface 19 and the measuring device 20 for determining the position (Y-axis) of the cantilever 7 is connected by means of an interface 21 with the control device 17, which, in turn, is connected to a memory 22.

For determining the position of the bale opener along the X-axis, on the carriage 5 a sensor 23 is mounted which responds to a marking element 24, such as an apertured strip, mounted on the duct 8. For determining the height position (Y-axis) of the cantilever 7, with a drive 25, such as a drive motor for the raising and lowering of the cantilever 7, there is associated a counter 25' which may comprise a photocell with an apertured disc. If, during one pass over the bale series 2*a* no more fiber material of the type A is required, the bale opener stops upon command from the control device 17, based on a "full" report from the measuring device 14. Thereupon the control device 17 asks the location of the bale opener (X and Y positions) from the measuring device 18 (connected with the sensor 23) and the measuring device 20 (connected with the counter 25'). Thereafter, the control device 17 stores the obtained information in the memory 22, and subsequently, controlled by the control device 17, the opening device 7' is lifted off the top face of the fiber bales and the carriage 5 is moved to the bale series 2*b* from which fiber material of the type B is obtained. If, at a later time, fiber material of the fiber type A is again needed, the carriage 5 moves to that location of the bale series 2*a* where precedingly the opening process was interrupted, lowers the cantilever 7 to the height earlier determined and stored in the memory 22 and resumes the fiber opening process.

It is noted that by fiber material there is meant such substance in its broadest sense and it may, apart from the pure fiber, contain impurities such as fiber waste. Fiber type, as the term is used here, designates the kind of fiber such as cotton, chemical fiber or the like.

It will be understood that the above description of the present invention is susceptible to various modifications, changes and adaptations, and the same are intended to be comprehended within the meaning and range of equivalents of the appended claims.

What is claimed is:

1. A method of selectively supplying fiber material from an output of a fiber bale opener to a plurality of fiber processing lines each formed of a series of fiber processing machines, including the steps of removing fiber by the bale opener sequentially from bales of different fiber types; supplying predetermined fiber processing lines with predetermined types of fiber by the bale opener; the improvement comprising the steps of (a) sensing a fiber quantity requirement of the fiber processing line while being supplied with fiber by the bale opener simultaneously performing fiber removal from the bales of a predetermined fiber type;

(b) interrupting the fiber removal at that location of the bale opener where it is situated when the fiber processing line then supplied with fiber, signals satisfaction of fiber requirement; and (c) resuming fiber removal of said predetermined fiber type at said location upon a signal for fiber requirement by the fiber processing line supplied in step (a).

2. A method as defined in claim 1, wherein step (b) comprises the step of interposing a short delay between signals indicating satisfaction of fiber requirement and interruption of fiber removal.

3. A method as defined in claim 1, further comprising the step of overriding steps (b) and (c) if, upon a signal of satisfaction of fiber requirement the bale opener is within a predetermined distance from a forward end of a bale group undergoing opening and proceeding with the opening of the last-named bale group until the end thereof.

4. In a fiber processing system including a bale opener having a carriage arranged for a back-and-forth travel in a path along a fiber bale series; a tower supported on the carriage and a cantilever mounted on the tower and arranged for vertical displacements with respect to the tower; an opening device supported in said cantilever and arranged for removing fiber from the bale tops during travel of the carriage; a plurality of fiber processing lines connected to an output of said bale opener; sensor means for determining fiber quantities in each said fiber processing line; a control device having an output connected to said bale opener for controlling the operation of the bale opener; said sensor means being connected to an input of said control device, the improvement comprising a first measuring means for determining a length position of said carriage along said path; said first measuring means being connected to an input of said control device; a second measuring means for determining a height position of said cantilever and said opening device; said second measuring means being connected to an input of said control device.

5. A fiber processing system as defined in claim 4, wherein said first measuring means comprises a sensor mounted on said bale opener and a marker element stationarily positioned along said path and cooperating with said sensor.

6. A fiber processing system as defined in claim 4, further comprising a drive means for raising and lowering said cantilever; said second measuring means comprising a counter connected to said drive means and generating signals representing height positions of said cantilever.

7. A fiber processing system as defined in claim 4, further comprising a memory connected to said control device.

8. A fiber processing system as defined in claim 7, wherein said memory is a buffered memory.

* * * * *